United States Patent [19]

English et al.

[11] Patent Number: 4,850,918

[45] Date of Patent: Jul. 25, 1989

[54] PULSED METAL HALIDE SOURCE

[75] Inventors: George J. English, North Reading; Harold L. Rothwell, Jr., Georgetown, both of Mass.; Donald F. Garrity, Jr., Chester, N.H.

[73] Assignee: GTE Products Corporation, Danvers, Mass.

[21] Appl. No.: 266,447

[22] Filed: Oct. 28, 1988

Related U.S. Application Data

[62] Division of Ser. No. 135,405, Dec. 18, 1987.

[51] Int. Cl.[4] ..... H01J 9/395; H01J 61/18

[52] U.S. Cl. ..... 445/40; 445/43

[58] Field of Search ..... 445/26, 40, 42, 43

[56] References Cited

U.S. PATENT DOCUMENTS

| | | | |
|---|---|---|---|
| 3,628,846 | 12/1971 | Cortorillo | 445/26 |
| 3,840,767 | 10/1974 | Lake | 313/639 |
| 4,001,626 | 1/1977 | Drop et al. | 313/639 X |
| 4,140,385 | 2/1979 | Shaw et al. | 313/15 X |
| 4,173,728 | 11/1979 | Witting | 313/638 X |
| 4,412,963 | 11/1983 | Hing | 65/43 X |
| 4,636,692 | 1/1987 | Lapatovich | 313/638 X |

*Primary Examiner*—Kenneth J. Ramsey

*Attorney, Agent, or Firm*—Joseph S. Romanow

[57] ABSTRACT

A mercury-free colored light source is especially well suited for use as a signal and/or navigational aid. The source is also adaptable to many other applications requiring momentary flashes of a particular color of light. The mercury-free, pulsed metal halide light source of the present invention comprises in combination:

(a) a light transmissive glass vacuum outer jacket;

(b) a light transmisive glass arc tube disposed within said outer jacket;

(c) emissive material comprising at least one metal halide salt and an inert gas; and (d) an anode and a cathode, disposed within said arc tube, forming a gap therebetween;

said cathode being completely covered by said metal halide salt.

7 Claims, 1 Drawing Sheet

PULSED METAL HALIDE SOURCE

STATEMENT OF GOVERNMENT SUPPORT

This invention was made with Government support under Contract No. DTCG23-87-C-20026, awarded by the U.S. Coast Guard. The Government has certain rights in this invention.

This is a divisional of co-pending application Ser. No. 135,405 filed on Dec. 18, 1987.

BACKGROUND OF THE INVENTION

Conventional metal halide discharge light sources typically comprise a fused silica tube with two electrodes, a rare gas for starting, a charge of mercury, and a fill comprising one or more metal halide salts, generally the iodides.

In their operation, a starting voltage of about 300 V is applied across the electrode gap causing the contents of the arc tube to vaporize, resulting in a high temperature, high pressure, wall stabilized arc in a gas, consisting principally of mercury vapor, ionized metal atoms and iodine molecules.

The output spectrum (i.e., the color of the discharge) of metal halide discharge lamps consists predominantly of the spectrum of the added metal halides. Color output for such lamps is tailored by varying the types of metal halides added to the arc tube. See for example, Waymouth, "Electric Discharge Lamps," Chapter 8, MIT Press, (1971).

The present invention represents a radical departure from the preexisting technology, namely the discovery of a metal halide arc lamp that does not employ mercury, the source cell of which can be formed from conventional glass, and which operates at near ambient temperature by means of a short duration, high pulse current.

SUMMARY OF THE INVENTION

The present invention is directed to a metal halide arc lamp which generates a flashing colored, preferably monochromatic, light. The applications for such a source include signal and warning lights as well as applications in the visual aids field.

As described in greater detail herein below, the lamp of the present invention can be easily fabricated from conventional borosilicate or alkali resistant glass (e.g., Pyrex®) and requires no auxiliary heating, even though the emissive material, i.e., the metal halide fill, is contained as a stable salt.

The pulsed metal halide lamp of the present invention comprises in combination:

(a) an evacuated, light transmissive glass outer jacket;

(b) a light transmissive glass arc tube disposed within said outer jacket;

(c) at least two electrodes disposed at opposing ends of said arc tube, forming a gap therebetween; and (d) emissive material comprising at least one metal halide salt, at least a portion of which is intermediate said electrodes, and an inert gas.

DETAILED DESCRIPTION OF THE PREFERRED EMBODIMENTS

Figure 1:
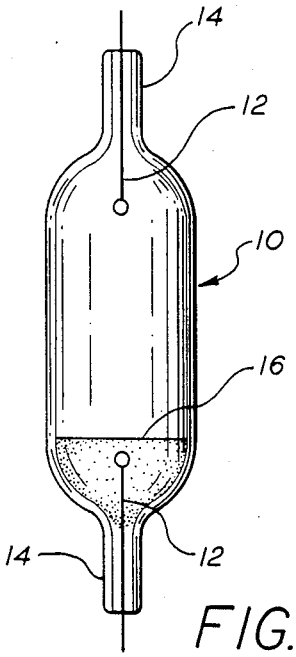
FIG. 1 illustrates a preferred configuration for the arc tube light source prepared according to the present invention.

A schematical drawing of the preferred arc tube light source of the present invention is shown in FIG. 1.

As illustrated, the source of radiant energy in the lamp of the present invention comprises a light transmissive radiating chamber 10, which is preferably cylindrical, being defined in preferred embodiments by a tubular section of thin walled Pyrex® glass. Opposing electrodes 12, preferably formed of tungsten, are sealed into either end of the chamber 14, preferably using a vacuum sealing technique.

The emissive fill 16, comprises one or more metal halide salts, preferably alkali metal iodides or bromides, and this fill may be added to the radiating chamber 10 after one of the electrodes 12 has been sealed into the end of the chamber 14.

In preferred embodiments, this fill is added as described, i.e., before the addition of a second electrode 12, thus providing a source with no auxiliary tubing on the side. An inert gas, preferably argon, is then added to the source, and the second electrode 12 is sealed in place 14. Such a construction is referred to as "tipless" which is generally not possible in traditional metal halide lamps.

An outer glass jacket (not illustrated) may be added to provide for convenient handling of the lamp.

While not wishing to be bound by theory, or to unduly limit the scope of the present invention, it has been discovered that a pulsed metal halide source prepared according to the present invention must have its cathode (negative (−) electrode) completely covered with the metal halide salt.

The metal halide salt is typically added as a granular or powdered fill which is thereafter melted and recrystallized around and over the cathode.

In practice, a natural gas torch is used to lightly heat up the cathode end of the cell during fabrication, causing melting of the metal halide salt around the cathode. Upon cooling, a solid mass of recrystallized (or fused) metal halide salt surrounds the cathode.

It has been discovered that at the cathode should be covered by at least about 0.5 mm of solidified metal halide salt. Lesser amounts will still work (providing the cathode is covered), but this represents a best estimate for the minimum amount of coverage required for consistently good performance. The gap remaining between the anode and the top of the salt layer should range from about 3 to 10 mm for conventional arc tubes (about 10–15 mm×3 mm).

Unlike other metal halide sources, it has surprisingly been discovered that changes in the spatial orientation of the present source does not adversely impact the light output. In conventional metal halide lamps, a change from vertical operation to horizontal operation dramatically reduces the light output. On the other hand, with the lamps of the present invention, either spatial orientation, vertical or horizontal, may be employed, each with satisfactory light output.

In preferred operations, a 1–2 kV potential with a time duration of a few microseconds (e.g. 1–100, preferably 1–50, most preferably 1–10) is initially applied across the electrodes, which readily produces a low level of ionization of the argon and subsequent glow in the arc tube between the bare anode and the salt covering the cathode. About a 300–400 volt potential is sustained across the gap between the anode and the salt during the high current pulse.

Figure 2:
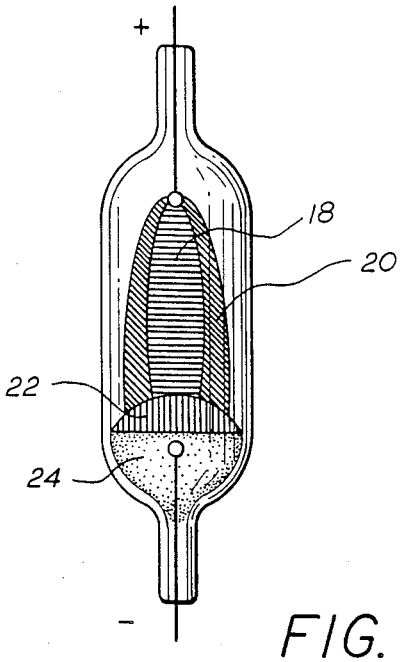
FIG. 2 represents the color output of an arc tube light source when lithium bromide is pulsed in accordance with the present invention.

FIG. 2 typifies what is observed when a cell prepared in accordance with the teachings of the present invention, and containing a preferred salt, lithium bromide, is pulsed in accordance with the above described procedures.

At the core of the chamber 18, the arc glows a bluish-white color, while away from the central core 20, the color shifts toward blue-green, mixed with red. Immediately above the lithium bromide fill 22, a red colored light is emitted from the lithium vapor, as well as from the LiBr salt 24.

If the arc is sustained, i.e., allowed to drain high levels of current (e.g., 0.5–1.0 amp), ionized argon atoms are accelerated toward the bottom electrode since that electrode is preferably the cathode. Many collisions between the argon and metal halide salt occur as the argon migrates toward the bottom electrode. Some of these collisions will produce dissociation of the metal from the halide and eventual excitation of the metal. The resulting emission from the excited metal provides the desired effect, i.e., colored light output.

As shown in FIG. 2, such a metal rich region forms slightly above the salt level. However, even within the salt region the metal can become excited so that emission is observed everywhere around the bottom electrode. For the preferred embodiment described herein the lithium generates its resonance radiation at 610 and 670 nanometers wavelength, which is observed as a red color by the human eye.

In addition to the preferred lithium bromide emissive source, other metal halide salt systems such as sodium iodide and thallium iodide have been tested, and they exhibit a similar effect.

The glow from the argon can be masked leaving visible only the emission from the salt region.

Figure 3:
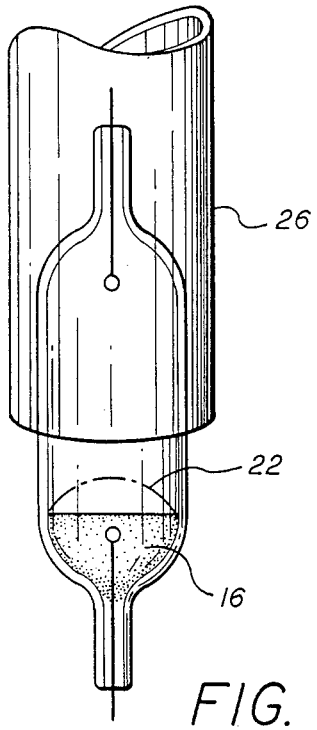
FIG. 3 illustrates one means for adjusting the color output of an arc source prepared in accordance with the teachings of the present invention, namely, the use of a coated reflector shield.

A mask 26 can be prepared from a reflector or a coated shield, which would be used to reflect energy back into the cell's interior as depicted in FIG. 3. Since the pressure of the argon is only a fraction of an atmosphere and the preferred electrode gap is less than about 1 cm, the glow transfers into an arc within several microseconds.

The source of the present invention has several advantageous fabrication features including:

The cell material can be Pyrex® or alkali resistant glass which is more easily worked than fused silica which requires high heat for forming. Moreover, the geometry of the cell apparently does not affect the performance. Ellipsoidal, tubular, and spherical shaped cells have been utilized in the present invention, all with success.

The availability of alternate types of glass results from the fact that the source is operated at near ambient temperatures, i.e., less than about 100° C., rather than the approx. 800° C., which is typical of most metal halide high intensity discharge sources.

The absence of a tip-off greatly improves the light distribution of the source in the present lamp. The source also has fairly uniform light output in the horizontal plane.

Since the majority of the discharge energy is confined to a columinar zone including the salt region, the radiating region is effectively cylindrical so that no preforming of the glass is necessary; merely a straight section of glass tubing is sufficient.

The energy conservation with this source should be improved over an externally heated system since bulk vaporization of the salt will not be necessary. The cell is basically cold.

Electrode maintenance should be improved since a diffuse contact at the cathode is guaranteed because of the salt coverage. In effect the salt disperses the plasma flow and provides many current paths to the electrode. Normally a gas arc will terminate on the cathode as a high current density spot which increases the local temperature of the electrode and contributes to erosion of the electrode.

The present invention has been described in detail, including the preferred embodiments thereof. However, it will be appreciated that those skilled in the art, upon consideration of the present disclosure, may make modifications and improvements on this invention and still be within the scope and spirit of this invention as set forth in the following claims.

What is claimed is:

1. A method of constructing a mercury-free, pulsed metal halide arc lamp comprising the steps of:

(a) forming a radiating chamber from glass;

(b) sealing an electrode into one end of said radiating chamber;

(c) adding emissive material in the form of a metal halide salt to said chamber, sufficient to cover said electrode;

(d) heating said metal halide salt to a sufficient temperature as to melt around said electrode, thereafter allowing the same to cool and solidify;

(e) sealing an additional electrode in the open end of said cylindrical chamber; and (f) adding sufficient inert gas to support mercury-free, pulsed ionization.

2. The method of claim 1, wherein the cylindrical radiating chamber is formed from thin walled borosilicate glass.

3. The method of claim 1, wherein the opposing electrodes are formed of tungsten.

4. The method of claim 3, wherein the electrodes are sealed into each end of the chamber using a vacuum sealing technique.

5. The method of claim 1, wherein the metal halide salt is recrystallized around one of the electrodes.

6. The method of claim 1, wherein the metal halide salt is fused around one of the electrodes.

7. The method of claim 1, wherein during lamp operation, the covered electrode is the cathode.

* * * * *